US008266916B2

(12) United States Patent
Dillon

(10) Patent No.: US 8,266,916 B2
(45) Date of Patent: Sep. 18, 2012

(54) COVER FOR A WALL-MOUNTED PACKAGED TERMINAL AIR CONDITIONING (PTAC) UNIT

(76) Inventor: John Dillon, Saugus, MA (US)

( * ) Notice: Subject to any disclaimer, the term of this patent is extended or adjusted under 35 U.S.C. 154(b) by 487 days.

(21) Appl. No.: 12/493,880

(22) Filed: Jun. 29, 2009

(65) Prior Publication Data

US 2010/0024459 A1 Feb. 4, 2010

Related U.S. Application Data

(60) Provisional application No. 61/133,349, filed on Jun. 27, 2008.

(51) Int. Cl.
*F25B 1/00* (2006.01)

(52) U.S. Cl. ..... 62/115; 62/263

(58) Field of Classification Search ..... 62/259.1, 62/262, 263, 428, 419, 115; 312/236, 101, 312/245; 29/700; 403/24, 288; 285/398, 285/275; 454/224, 237
See application file for complete search history.

(56) References Cited

U.S. PATENT DOCUMENTS 3,534,724 A 10/1970 Petz
3,665,726 A * 5/1972 Preotle ..... 62/262
3,911,803 A * 10/1975 Kong et al. ..... 454/203
3,917,757 A 11/1975 Hoag
4,325,594 A 4/1982 Lang et al.
4,332,114 A 6/1982 Goebel et al.
4,740,091 A * 4/1988 Bolton et al. ..... 403/24
4,759,194 A 7/1988 Shapiro
4,788,805 A 12/1988 Shaw
4,877,106 A 10/1989 Neville et al.
4,958,500 A * 9/1990 Kuroda et al. ..... 62/89
5,315,842 A 5/1994 Bolton et al.
D417,724 S 12/1999 Okamoto et al.
6,061,981 A 5/2000 Nieves
6,230,510 B1 5/2001 Price
6,279,339 B1 8/2001 Correa et al.
D456,068 S 4/2002 Oya et al.
6,435,632 B1 8/2002 Correa
6,497,463 B2 12/2002 Moretti
6,497,740 B1 * 12/2002 Moretti ..... 55/418
D468,418 S 1/2003 Ilicic
6,701,741 B2 * 3/2004 Liu ..... 62/429
7,258,606 B1 8/2007 Reid
7,296,424 B2 * 11/2007 Thompson ..... 62/115

* cited by examiner

*Primary Examiner* — Mohammad Ali
(74) *Attorney, Agent, or Firm* — Hamilton, Brook, Smith & Reynolds, P.C.

(57) ABSTRACT

Embodiments of the present invention provide a cover for a Packaged Terminal Air Conditioning (PTAC) unit. Embodiments of the cover include a gasket on an interior portion of the cover sealing against a portion of the PTAC unit to prevent air recirculation. Other embodiments of the cover include a screen configured to capture large debris. Other embodiments of the cover include solid wood panels with stain and lacquer on both sides of the panels.

20 Claims, 4 Drawing Sheets

COVER FOR A WALL-MOUNTED PACKAGED TERMINAL AIR CONDITIONING (PTAC) UNIT

RELATED APPLICATION

This application claims the benefit of U.S. Provisional Application No. 61/133,349, filed on Jun. 27, 2008.

BACKGROUND OF THE INVENTION

Hotel rooms and other locations are typically equipped with wall-mounted heating, ventilation, and air conditioning units, commonly known as Packaged Terminal Air Conditioning (PTAC) units. The PTAC units pull air from a room through intake vents and then heat or cool the air before discharging the air back into the room. PTAC units are unsightly and may produce noise from machinery, such as a compressor.

SUMMARY OF THE INVENTION

Embodiments of the present invention provide a cover fitting over a wall-mounted unit providing one or more of heating, ventilation, and air conditioning, including Packaged Terminal Air Conditioning (PTAC) units. The cover includes air passages, e.g., slots or holes, for venting air from the PTAC unit to a room and additional air passages to supply air from the room to the PTAC unit. Embodiments of the cover include wood that is stained, painted, or treated to match furniture in a room. Embodiments of the cover may also include a screen to trap large debris, e.g., pieces of paper or plastic bags. Embodiments of the cover also include a device to prevent intake air from mixing with discharge air within the cover. The device may be a gasket. Additional embodiments of the cover include an access door to provide access to a control panel on the PTAC unit. Further embodiments of the cover include a removable panel that has air passages, e.g., slots or holes, for venting air to a room from the PTAC unit. In some embodiments, the removable panel is made from a material that is different from the remainder of the PTAC cover.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
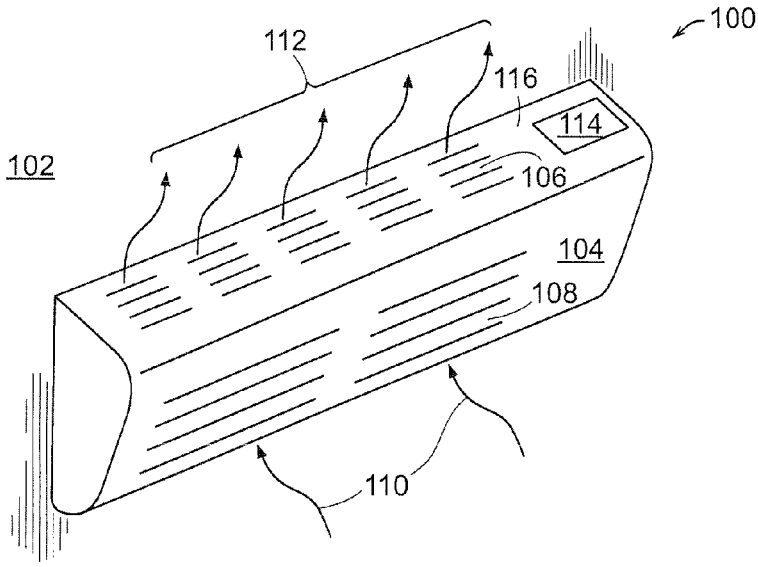
FIG. 1 is a perspective view of a prior art Packaged Terminal Air Conditioning (PTAC) unit mounted in a wall with the PTAC unit casing extending from the wall.

FIG. 1 is a perspective view of a typical Packaged Terminal Air Conditioning (PTAC) unit 100 mounted to a wall 102. A PTAC unit is typically installed in a hotel room, an apartment, or another building where it is desirable to heat and cool individual rooms or defined spaces within the building. The PTAC unit 100 has a casing 104 with areas for air intake and air discharge such as air intake passages, e.g., slots or holes, 108 and air discharge passages, e.g., slots or holes, 106. Air flows into the PTAC unit (denoted by arrows 110) through the air intake passages 108. The air is then heated or cooled, depending on a selected mode of operation, and flows out of the PTAC unit (denoted by arrows 112) through the air discharge passages 106. The air may not be heated or cooled, and instead merely be passed through the unit, as just described, to provide air circulation. The air discharge passages 106 may be formed on an angled portion 116 of the casing 104 such that discharge air 112 is directed into the room. The PTAC unit is optionally equipped with controls (not shown) covered by door 114. The controls (not shown) typically enable adjusting temperature and fan speed. Alternatively, the PTAC unit casing 104 may not carry the controls and door 114, and the controls (not shown) are mounted at a remote location, such as a wall (wall 102 or a different wall). The controls (not shown) may also be provided in a remote control device (not shown).

Throughout this application, in-wall heating, ventilation, and air conditioning units are referred to as PTAC units. The term PTAC is meant to include any device generally operating in a manner described above with respect to FIG. 1, regardless of whether it is called a PTAC unit.

Figure 2:
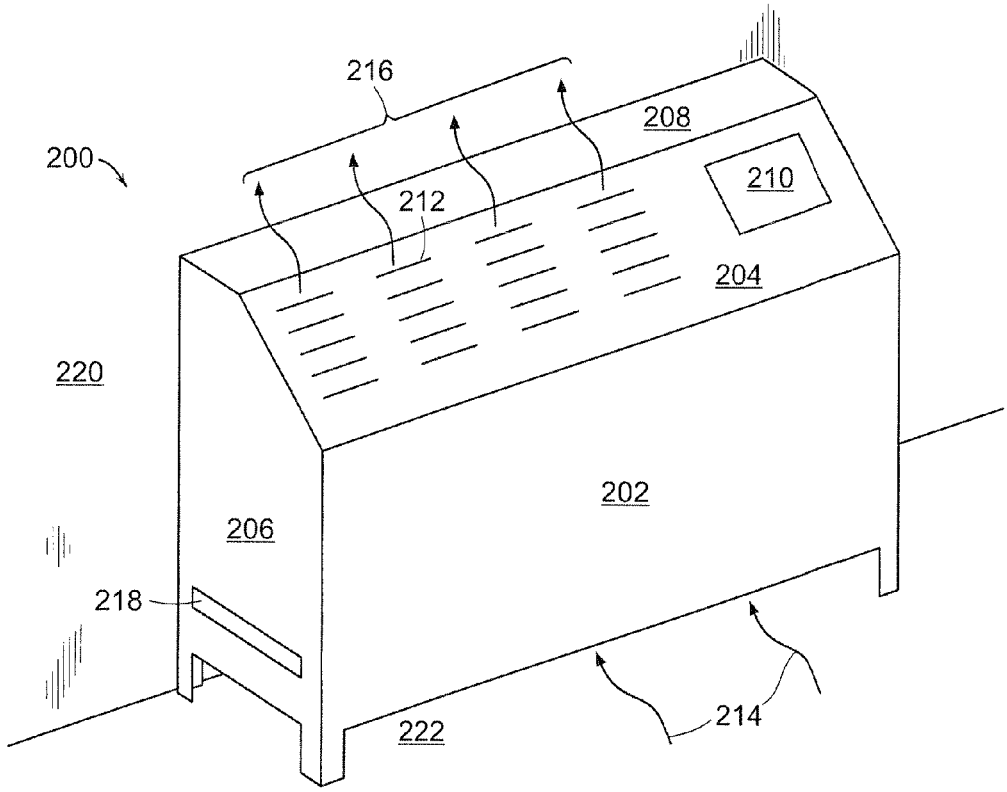
FIG. 2 is a front perspective view of an embodiment of a PTAC unit cover according to the present invention.

FIG. 2 is a perspective view of an embodiment of a PTAC unit cover 200 according to the present invention installed over a PTAC unit casing (not shown in FIG. 2, but may be casing 104 in FIG. 1, for example) mounted against a wall 220. The PTAC unit cover 200 has a front panel 202, side panels 206 (only one side panel is visible), and angled panel 204, which is substantially parallel to the portion of the PTAC unit's casing having the air discharge passages, e.g., slots or holes, (such as panel 116 in FIG. 1). The PTAC unit cover 200 may optionally include a substantially horizontal panel 208. The substantially horizontal panel 208 and side panels 206 may extend to varying depths from the wall 220 to accommodate PTAC units of varying depths (not shown) from the wall 220. The PTAC unit cover 200 also optionally carries screen 218, which extends beneath the PTAC unit (not shown).

Air enters the PTAC unit cover 200 through one or more air passages 222 at the bottom of the PTAC unit cover 200. Entering air is denoted by arrow 214. The entering air 214 passes through a screen 218 (when the screen is installed), which can trap large particulates and debris. The entering air 214 then enters a PTAC unit (not shown) to be heated or cooled or passed through. The heated or cooled air then exits the PTAC unit cover through air passages, e.g., slots or holes, 212. The exiting air is denoted by arrow 216.

The PTAC unit cover 200 optionally carries access door 210, which provides access to PTAC controls and door (such as door 114 and controls (not shown) in FIG. 1).

Figure 3:
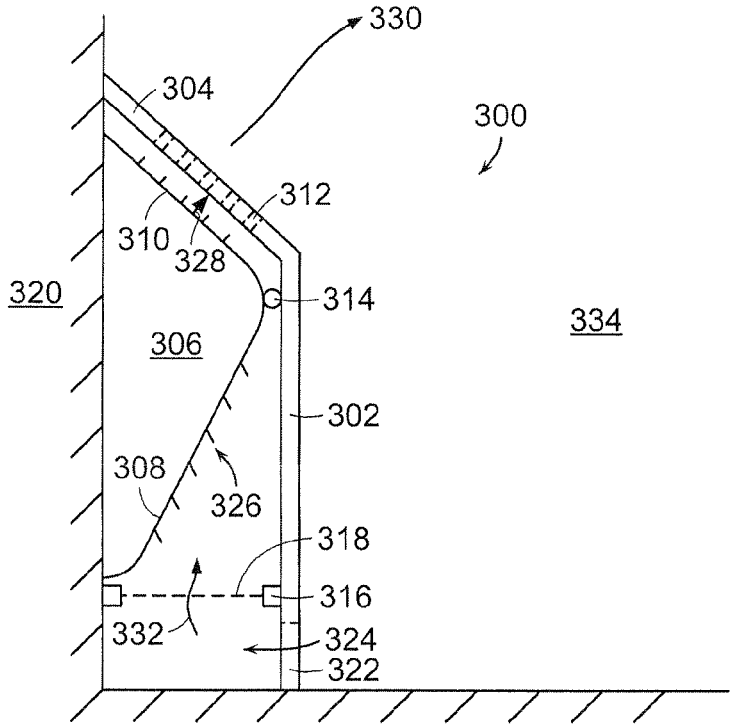
FIG. 3 is a side view of an embodiment of a PTAC unit cover according to the present invention covering a PTAC unit with a side panel removed to show the PTAC unit casing within.

FIG. 3 is a side view of a PTAC unit casing 306 mounted to a wall 320 and covered by an embodiment of a PTAC unit cover 300 according to the present invention, with a side panel of the cover removed to show the PTAC unit casing 306 within. The PTAC unit casing 306 has air intake passages 308 and air discharge passages 310. The PTAC unit cover 300 has an upper panel 304 and a lower panel 302. The upper panel 304 is substantially parallel to the PTAC unit casing surface carrying the air discharge passages 310. Through experimentation, it has been determined that the distance between the PTAC casing surface carrying air discharge passages 310 and surface 304 of the cover 300 should be less than one inch and preferably about one-half of an inch to minimize efficiency losses. Cover 300 also includes a device, such as a gasket 314, pressed against the PTAC unit casing 306. The gasket 314 may be a foam rubber material or foam plastic material, such as polyethylene, or any other material that is compressible and conformable. Cover 300 also includes a screen 316, 318 beneath the PTAC unit casing 306. The screen includes a frame 316 and screen material 318.

FIG. 3 illustrates typical airflow through the PTAC unit cover 300 and PTAC unit casing 306. Air from a room 334 flows through one or more air passages 322 at the bottom of the PTAC unit cover 300. This air flow is denoted by arrow 324. In embodiments including a screen, such as screen 316, 318, the air flows through the screen material 318 (denoted by arrow 332). The screen 318 traps large debris, such as paper or plastic (not shown). The air then enters the PTAC unit casing 306 via air intake passages 308 (denoted by arrow 326). Inside the PTAC unit casing 306, the air is optionally either heated or cooled, depending on the selected operation of the PTAC unit. Alternatively, the PTAC unit may pass air through without heating or cooling to circulate air within a room. After the air goes through the PTAC unit (and is optionally heated or cooled), the air exits the PTAC unit casing through air discharge passages 310 (denoted by arrow 328). The air then passes through air passages 312 in the PTAC unit cover 300 (denoted by arrow 330) to return to the room 334. Gasket 314 prevents air flow 328 coming from air discharge passages 310 from passing between the PTAC unit casing 306 and the PTAC unit cover 300 and re-entering the air intake passages 308. Gasket 314 also prevents air entering the PTAC unit cover 300 through the one or more openings 322 from bypassing the PTAC unit casing 306 and passing out through air passages 312 in the PTAC unit cover 300.

Figure 4:
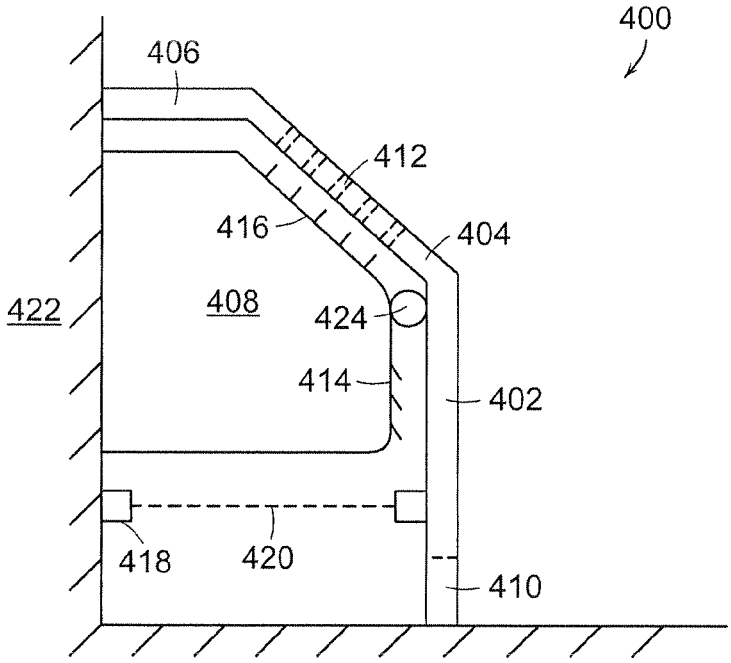
FIG. 4 is a side view of an embodiment of a PTAC unit cover according to the present invention covering a PTAC unit with greater depth than the PTAC unit of FIG. 3 and with a side panel removed to show the PTAC unit casing within.

FIG. 4 is a side view of a PTAC unit casing 408 mounted to a wall 422 and covered by an embodiment of a PTAC unit cover 400 according to the present invention, with a side panel of the cover removed to show the PTAC unit casing 408 within. Compared to FIG. 3, the PTAC unit casing 408 shown in FIG. 4 extends further from the wall 422. As a result, the PTAC unit cover 400 has to accommodate the greater depth dimension of the PTAC unit casing 408. The PTAC unit cover 400 in this example embodiment adds depth by adding a horizontal panel 406 behind angled panel 404. Sides of the cover (not shown in FIG. 4, but see panel 206 in FIG. 2 by way of example) and screen 418, 420 also have added depth compared to the example embodiment in FIG. 3. Note that the PTAC unit cover 400 has angled panel 404 substantially parallel to the PTAC unit casing 408 carrying air discharge passages 416. As in FIG. 3, the distance between the angled panel 404 and the PTAC unit casing 408 is advantageously less than one inch and preferably about one-half of an inch.

Figure 5:
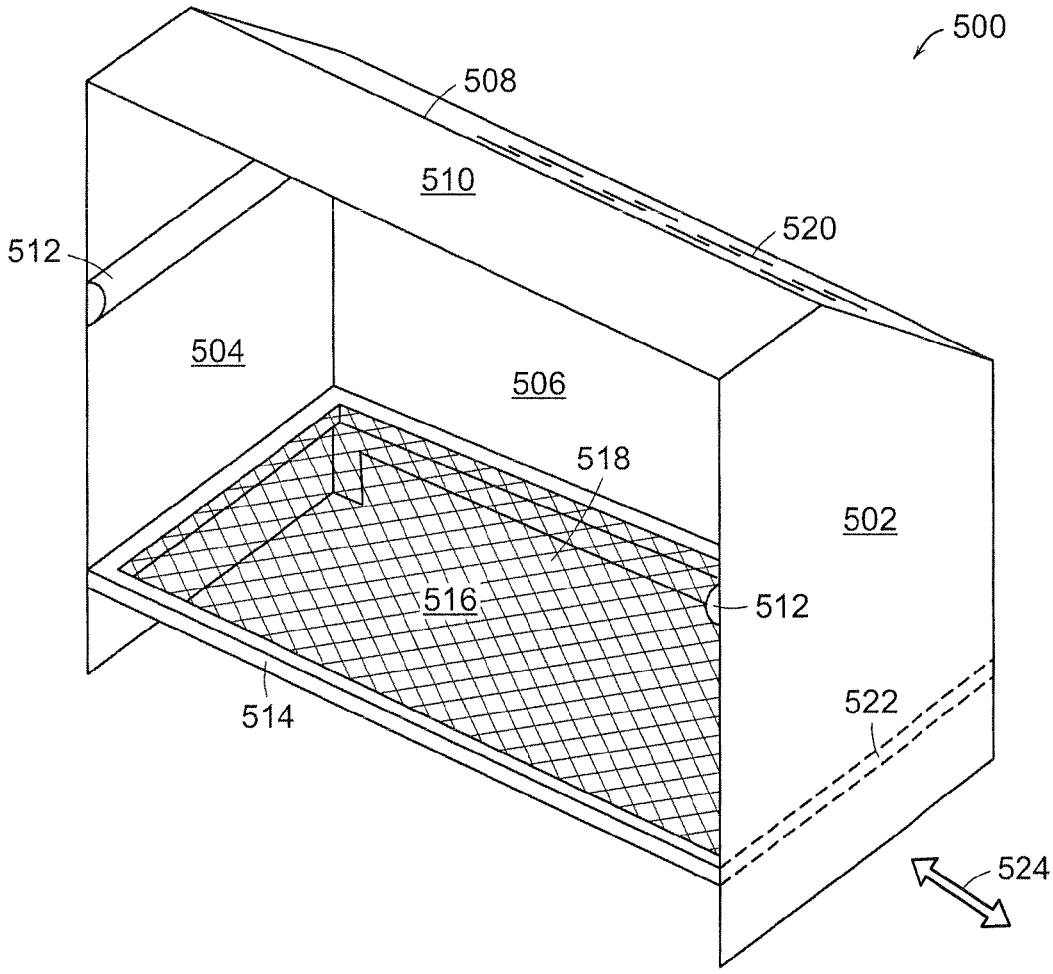
FIG. 5 is a rear perspective view of an embodiment of a PTAC unit cover according to the present invention.

FIG. 5 is a perspective view of an embodiment of a PTAC unit cover 500 according to the present invention. The PTAC unit cover 500 has a front panel 506 carrying air intake opening 518, angled panel 508 carrying air discharge passages 520, top panel 510, and side panels 502, 504. The perspective view of FIG. 5 shows the interior portion of the PTAC unit cover 500, which is not visible when the PTAC unit cover 500 is installed over a PTAC unit casing (not shown) against a wall (not shown). FIG. 5 also shows a gasket 512 installed on an interior portion of side panels 502, 504 and on front panel 506. Although partially obscured in this perspective view, the gasket 512 is installed so that it provides a continuous seal between the PTAC unit casing (not shown) and PTAC unit cover 500 on side panel 504, front panel 506, and side panel 502. The gasket 512 is installed in the PTAC unit cover 500 at a location, i.e., height, where, when the PTAC unit cover 500 is installed over a PTAC unit casing (not shown), the gasket is compressed against a portion of the PTAC unit casing (not shown) between the PTAC unit casing's air intake passages (not shown) and air discharge passages (not shown). FIG. 5 also shows screen material 516 mounted in a frame 514. The frame 514 and screen 516 are installed in the PTAC unit cover 500 at a location, i.e., height, where, when the PTAC unit cover 500 is installed over a PTAC unit casing (not shown), the frame 514 and screen 516 are located beneath the PTAC unit casing (not shown) and in the flow path of air traveling from the air intake opening 518 in the PTAC unit cover 500 to the air intake passages (not shown) on the PTAC unit casing (not shown). The side panel 502 also carries a slot 522 that provides access to frame 514 and screen 516. A maintenance person, or any other person, may easily remove and insert the screen 516 and frame 514 by sliding the frame 514 and screen 516 in the direction of arrow 524. Such removal allows for easy cleaning of debris collected by the screen 516 or for easy replacement of the screen. For simplicity, no structure is shown in FIG. 5 to support the frame. A person having ordinary skill in the art would understand that any commonly available support, such as guide rails, may be used to support the frame.

The PTAC unit cover is subject to varying air temperatures, both hot and cold, flowing from the air discharge passages of the PTAC unit casing. The material for the panels needs to be chosen to sustain these varying temperatures and the drying effects of the air flow. Embodiments of PTAC unit covers according to the present invention include wood surfaces on side panels (such as panels 502, 504 in FIG. 5), front panel (such as panel 506 in FIG. 5), angled panel (such as panel 508 in FIG. 5), and substantially horizontal panel (such as panel 510 in FIG. 5) (when present) that are colored with paint or stain to match other furniture in the room. The panels may be made entirely of solid wood or may include wood veneers over a backing. The backing may be particle board, metal, plastic, or any other material providing strength and rigidity for the cover. Applying color stain and lacquer to all surfaces of wood, including interior surfaces of panels of the PTAC unit cover (for example, shown in FIG. 5), helps to protect the wood from warpage or cracking that may result from the extreme temperatures. The color stain draws moisture out of the wood and the lacquer seals the wood from moisture intrusion. Two coats of lacquer provides better moisture protection than a single coating.

Embodiments of a PTAC unit cover according to the present invention provide some sound deadening of noises emanating from the PTAC unit. For example, PTAC units include a compressor that may be noisy. Containing the PTAC unit within a PTAC unit cover muffles at least some of the noise. Additional noise reduction may be achieved by lining interior surfaces of panels of a PTAC unit cover with sound deadening materials.

Embodiments of a PTAC unit cover according to the present invention may be made out of material other than wood. Chosen materials must be structurally sufficient to support the weight of the cover and be sufficiently rigid to avoid substantial deformation when stresses are applied, such as stresses caused by a person sitting or leaning on the cover. Typically, the chosen materials or at least the chosen materials for the outer surfaces of the cover match the decor of the room, e.g., matching other woods found in the room, matching metal finishes found in the room, etc.

Figure 6A:
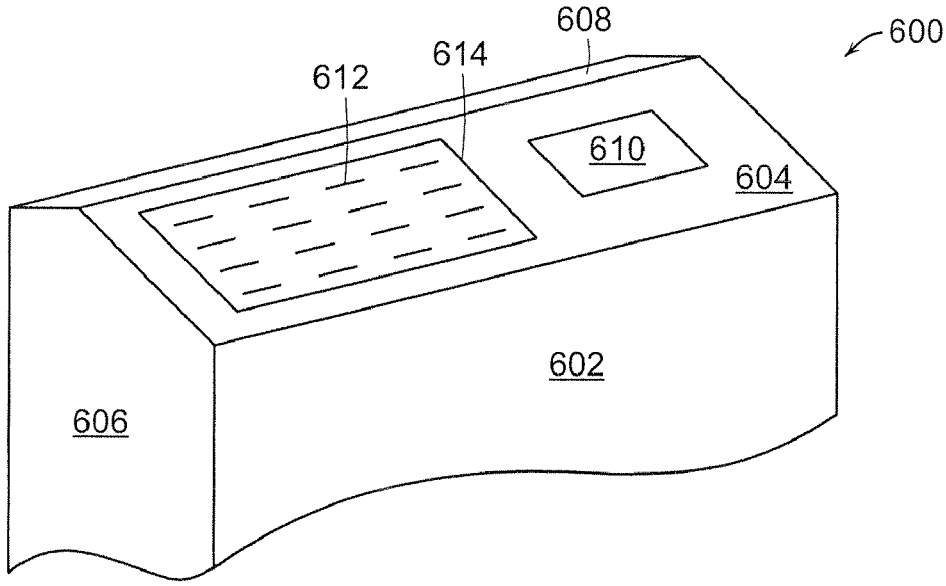
FIGS. 6A and 6B show a perspective view of an embodiment of a PTAC unit cover having a removable panel carrying air passages.
Figure 6B:
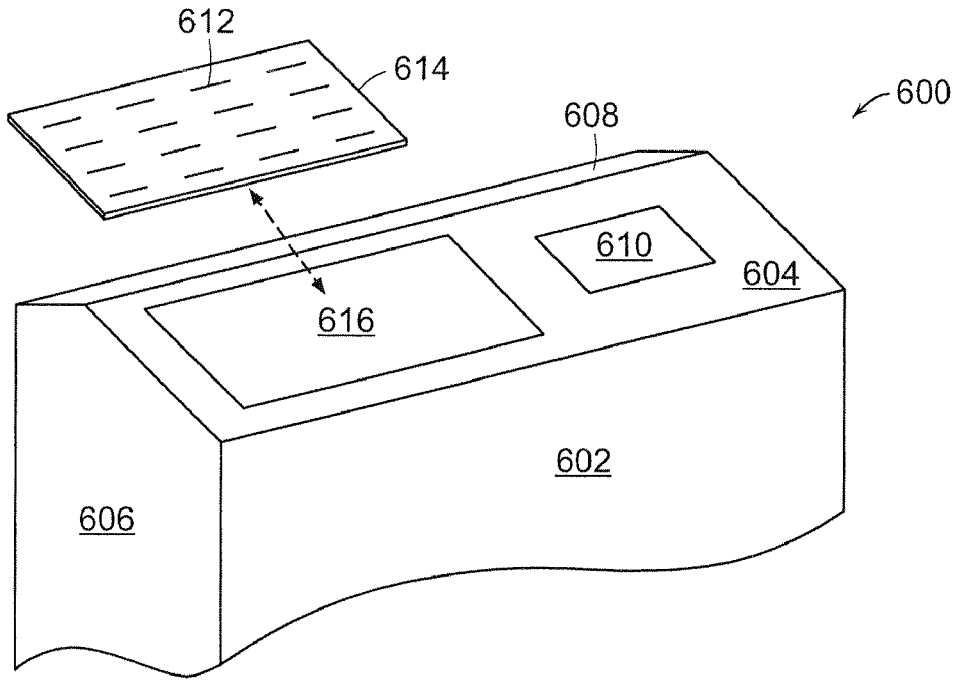

FIGS. 6A and 6B are a perspective view of an embodiment of a PTAC unit cover 600 with a removable panel 614. The PTAC unit cover has a front panel 602, side panels 606 (only one side panel is visible), a substantially horizontal panel 608, and angled panel 204. The air passages 612 through which air from the PTAC (not shown) is discharged are formed in a removable panel 614. The removable panel 614, when installed in the PTAC cover 600, sits in a hole 616 in angled face 608. The removable panel 614 enables transport of the removable panel 614 and the air passages 612 for cleaning. Further, the removable panel 614 may be made of a material that is different from the remainder of the PTAC cover 600. For example, the PTAC cover 600 may generally by made of a wood that matches a room's decor (not shown), but the removable cover 614 and the air passages 612 may be made of metal or plastic.

PTAC unit covers according to the present invention preferably achieve at least about 90% or at least about 91% or at least about 92% or at least about 93% or at least about 94% or at least about 95% or at least about 96% or at least about 97% efficiency compared to an uncovered PTAC unit. Efficiency may be measured in many different ways. For example, a first measure of efficiency is air flow from a PTAC unit with an embodiment of a PTAC cover compared to air flow from the PTAC unit in an uncovered state. As another example, a second measure of efficiency is fan speed required to achieve a certain level of air flow from a PTAC unit covered by an embodiment of a PTAC cover compared to fan speed required to achieve the certain level of air flow from the PTAC unit in an uncovered state. As yet another example, a third measure of efficiency is PTAC unit energy usage to achieve a certain level of air flow from the PTAC unit covered by an embodiment of a PTAC cover compared to energy usage required to achieve the certain level of air flow from the PTAC unit in an uncovered state. A person having ordinary skill in the art would understand that efficiency may be measured in other ways.

While this invention has been particularly shown and described with references to example embodiments thereof, it will be understood by those skilled in the art that various changes in form and details may be made therein without departing from the scope of the invention encompassed by the appended claims.

What is claimed is:

1. A cover for a Packaged Terminal Air Conditioning (PTAC) unit, comprising:

a plurality of panels configured when in an installed state to conceal a PTAC unit and to be flush against a wall, the panels including a first panel with air passages, the first panel configured when in the installed state to be parallel and proximate to a portion of the PTAC unit having air discharge passages, and a second panel with at least one air passage configured when in the installed state to enable air to flow to air intake passages of the PTAC unit; and at least one gasket, mounted to an interior portion of at least one panel, configured to contact the PTAC unit and to inhibit air from flowing from the air discharge passage of the PTAC unit through a volume between the PTAC unit and the cover to the air intake passage of the PTAC unit when the cover is in the installed state.

2. The cover of claim 1 further comprising a screen mounted to the cover and configured when in the installed state to be in the path of air flow to the air intake passages of the PTAC unit.

3. The cover of claim 1 wherein the plurality of panels are made of wood and all surfaces of the wood are stained and coated with at least two coats of lacquer.

4. The cover of claim 1 wherein the plurality of panels are made of wood and all surfaces of the wood are painted and coated with at least two coats of lacquer.

5. The cover of claim 1 wherein the gasket is made of foam plastic.

6. The cover of claim 1 further comprising an access door on one of the plurality of panels configured to provide access to a control panel on the PTAC unit.

7. The cover of claim 1 wherein the cover results in at least about 90% efficiency compared to an uncovered PTAC unit.

8. The cover of claim 1 wherein the air passages carried in the first panel are carried in a removable portion of the first panel.

9. The cover of claim 8 wherein the removable portion of the first panel is made of a material different from that of a remaining portion of the first panel.

10. A method of covering a Packaged Terminal Air Conditioning (PTAC) unit, comprising:

enclosing a volume around a PTAC unit;

providing a first air passage through a boundary of the volume through which an air flow path from a room to air intake passages on the PTAC unit passes;

providing a second air passage, proximate and parallel to air discharge passages on the PTAC unit, through a boundary of the volume through which an air flow path from air discharge passages on the PTAC unit to the room passes; and isolating a first portion of the volume, in fluid communication with the air intake passages on the PTAC unit, from a second portion of the volume, in fluid communication with the air discharge passages on the PTAC unit.

11. The method of claim 10 further comprising locating a screen in the first portion of the volume and in the air flow path from the room to the PTAC unit.

12. The method of claim 10 wherein enclosing a volume around a PTAC unit includes surrounding the PTAC unit with a plurality of panels.

13. The method of claim 12 wherein the plurality of panels are wood panels; and further comprising staining the wood panels and then coating the wood panels with two coats of lacquer.

14. The method of claim 12 wherein the plurality of panels are wood panels; and further comprising painting the wood panels and then coating the wood panels with two coats of lacquer.

15. The method of claim 12 wherein isolating a first portion of the volume in fluid communication with the air intake passages on the PTAC unit from a second portion of the volume in fluid communication with the air discharge passages on the PTAC unit includes placing a gasket between at least one of the plurality of panels and the PTAC unit.

16. The method of claim 12 further comprising providing an access door in one of the plurality of panels, the access door configured to enable access to a control panel on the PTAC unit.

17. The method of claim 12 wherein providing the second air passage through the boundary of the volume includes placing air passages in at least one of the plurality of panels.

18. The method of claim 17 wherein placing air passages in at least one of the plurality of panels includes placing the air passages in a portion of a panel configured to be removed from and reinstalled onto the remainder of the panel.

19. The method of claim 18 wherein the portion of the panel configured to be removed from and reinstalled onto the remainder of the panel is made of a different material than the remainder of the panel.

20. A cover for a Packaged Terminal Air Conditioning (PTAC) unit, comprising:

a plurality of panels including a first panel with at least one air passage and a second panel with at least one air passage; and a gasket mounted to interior portions of the panels;

the plurality of panels configured so that when in an installed configuration the cover is flush against a wall and conceals a PTAC unit, the at least one air passage of the first panel configured to be parallel and proximate to a portion of the PTAC unit with air discharge passages, the at least one air passage of the second panel configured to allow air to flow to air intake passages of the PTAC unit; and the gasket configured to form a seal between the plurality of panels and the PTAC unit, inhibiting air flow between the air intake passages and air discharge passages of the PTAC unit.

* * * * *